US005305570A

United States Patent [19]

Rodriguez et al.

[11] Patent Number: 5,305,570

[45] Date of Patent: Apr. 26, 1994

[54] PANEL ELEMENT FOR FORMING A CONTINUOUS COVERING ON A BUILDING

[76] Inventors: Melchor Rodriguez; Santiago Menendez, both of 45 Robina Ave., π1B, Toronto, Ontario, Canada, M6C 3Y5

[21] Appl. No.: 958,821

[22] Filed: Oct. 9, 1992

[51] Int. Cl.[5] ..... E04D 1/00

[52] U.S. Cl. ..... 52/520; 52/533; 52/536; 52/539

[58] Field of Search ..... 52/518, 520, 521, 527, 52/536, 538, 539, 533

[56] References Cited

U.S. PATENT DOCUMENTS

| | | | |
|---|---|---|---|
| 1,427,968 | 9/1922 | Pedersen | 52/538 |
| 3,875,714 | 4/1975 | Nayler et al. | 52/538 X |
| 4,015,391 | 4/1977 | Epstein et al. | 52/539 X |
| 4,435,938 | 3/1984 | Rutkowski et al. . | |
| 4,522,002 | 11/1985 | Davis et al. . | |
| 4,680,911 | 7/1987 | Davis et al. | 52/539 X |
| 4,729,202 | 3/1988 | Ferland | 52/536 X |
| 5,048,255 | 9/1991 | Gonzales | 52/538 X |
| 5,070,671 | 12/1991 | Fifield et al. | 52/536 |
| 5,072,562 | 12/1991 | Crick et al. . | |
| 5,076,037 | 12/1991 | Crick et al. . | |

FOREIGN PATENT DOCUMENTS 2037429 3/1991 Canada .

*Primary Examiner*—Neill R. Wilson

*Attorney, Agent, or Firm*—Bereskin & Parr

[57] ABSTRACT

A panel element for use as a roof tile or other building element, e.g. on a vertical surface, is molded in one piece and includes upper, lower and left and right marginal edge regions. To facilitate securing the panel in place, the upper edge region may include fastening apertures. The lower marginal edge region of each panel is secured to the upper edge region of another panel in a lower row of panels. For this purpose, interlocking formations are provided in the upper and lower marginal edge regions, with the locking formation in the upper marginal edge region being below the nail apertures. This locking formation can serve both to prevent water travelling up to the nail apertures and as a locking formation. Support ribs under the panels can provide both uniform support from an underlying planar surface, and can also form the locking formations. The panel can be molded in any suitable material to simulate a variety of known tiles or other building elements.

13 Claims, 5 Drawing Sheets

PANEL ELEMENT FOR FORMING A CONTINUOUS COVERING ON A BUILDING

FIELD OF THE INVENTION

The present invention relates to roof and wall tile panels intended f or indoor or outdoor usage, and more particularly, to individual roof and wall tile panel elements which can be moulded or otherwise formed with decorative patterns characteristic of conventional roofing and siding materials such as shake, tile, brick or the like.

BACKGROUND

At the present time, most domestic roof s in North America are roofed or covered with shingles. Other roofing materials are known, such as wooden shakes and rigid tiles. Wooden shakes offer greater durability, but are relatively expensive and time consuming to lay. A variety of rigid tiles are gaining some popularity. For domestic use these are usually clay tiles. For industrial use they may be formed of concrete or other materials. Such rigid tiles will often be moulded with various ridges around their peripheries to prevent water leaking between adjacent tiles. However, such tiles are heavy and relatively expensive.

More recently a variety of synthetic roof and wall coverings have become known in the art. For example, there are panels formed of elongated thermoplastic panel elements that are nailed to the wall or roof support surface in horizontal courses or rows in partially overlapping relation to each other so as to provide a substantially water resistant, protective layer over the support surface. Such panels are usually identically moulded, and typically are formed with a plurality of rows of simulated building elements, such as shake shingles. In such panels, the individual building elements of each row commonly are moulded in laterally spaced relation with a separating groove therebetween. While it is desirable that the panels facilitate drainage of rain water and the like to which they are exposed in the outside environment, heretofore this has presented problems, since water can be drawn inwardly between overlapping marginal edge portions of adjacent panels and enter the space beneath the panels, either through nail holes or about the peripheral edges of the panels and become trapped and accumulate under the panels. Water movement can be caused by various factors, such as capillary action and pressure differences caused by wind. Such water movement worsens during high wind and storm conditions. Not only does the trapped moisture under the panels increase the possibility for leakage and damage to the wall or roof, but upon freezing, the expanding moisture tends to lift the overlapping edge portions further breaking the protective barrier between the panels and the support surface. When efforts have been made to prevent such capillary seepage between panels, they often have been ineffective, or have complicated the construction and cost of the panel, or have impeded the natural drainage of water from the panels.

A further difficulty with available building elements or tiles is that in practice they are difficult to assemble on the support surface.

To function properly as seals, the fit between overlapping panels must necessarily be exact and there is little or no flexibility to allow for inaccuracies in installation. For example, in U.S. Pat. No. 5,072,562 (Dec. 17, 1991) and U.S. Pat. No. 5,076,037 (Dec. 31, 1991) to Crick et al, assigned to Nailite International, the wall covering disclosed consists of an interlocking means which defines primary and secondary seals between the upper marginal edge region of the panel in one course and the overlapping lower marginal edge region of the panel in the course immediately above. This includes a top panel with a downturned lower peripheral lip which bears against the face of a ledge of the underlying panel thus establishing a primary seal; the underlying panel has an upper peripheral edge in the form of an upwardly turned sealing lip which can be positioned to engage with the underside of the lower marginal edge portion of the overlapping panel and establish a secondary seal. Between the two sealing means are provided additional water barrier means, namely a plurality of parallel barrier ridges in vertically spaced relation to one another which are integrally formed on the upper marginal region of each panel, and a pair of uninterrupted upstanding nail aperture guard ridges extending outwardly and which are integrally formed on the upper marginal panel.

In the commercial embodiment of the patents to Nailite, as known to the applicants interlocking means is provided consisting of an upper marginal edge region of a lower panel which is engaged by a plurality of downward-directed hooks which form part of the lower peripheral edge region of an upper panel in the course immediately above. The hook is adapted to engage the lower panel by insertion between the support surface and the upper portion of the upper marginal edge region of the lower panel, the upper portion being located above the nail aperture. The hook thus tends to pull the upper portion of the lower panel away from the support surface, and weaken the contact between the support surface and the lower panel, as well as to provide an area where water could gather between the support surface and the lower panel. Neither parallel barrier ridges nor nail guard aperture ridges are provided as disclosed in the patents. Further the additional seal provided by engagement of the lower peripheral lip of one panel with a ledge below the nail apertures of a panel below is omitted.

While such known panels are provided in large sizes to make installation easier, they are of relatively flimsy construction and include little support underneath. Consequently walking on the tiles would cause repeated flexing of the tile, and possibly could eventually crack the tile.

It is an object of the present invention to provide wall and roof tile panels which are adapted for easy alignment and mounting through simple interlocking means, such that successive courses of panels can be quickly and easily mounted on the support surface. It is also desirable that any interlocking arrangement should not interfere with the mounting provided by an upper row of nail apertures and further preferably includes any additional water barrier.

Such tiles should be capable of being moulded simply and economically in a plastic or synthetic material, and should be configured to provide good support any person walking on them.

SUMMARY OF THE PRESENT INVENTION

In accordance with the present invention, there is provided a panel element, which is generally rectangular, for mounting on a support surface and forming a continuous covering with a plurality of similar panel elements, the panel elements comprising:

a main body;

an upper marginal edge region along one, upper edge of the main body, including apertures for fasteners, for fastening the panel element to an underlying support surface, and a barrier ridge extending generally upwardly above the main body, to hinder upward movement of water towards the fastener apertures;

a lower marginal edge region along another, lower edge of the main body, and adapted to overlap the upper marginal edge region of an adjacent panel element, the lower marginal edge region including a lower edge strip at the lowermost end thereof, extending below the main body;

complementary left and right marginal edge regions along opposite other edges of the main body, and adapted to enable adjacent panels to overlap and engage one another, the marginal edge regions being configured to impede flow of water between engaged edge regions of adjacent panels;

a first locking formation provided below the upper marginal edge region, so as to be below any fasteners inserted through the upper marginal edge region, the first locking formation comprising a plurality of locking tabs extending away from the lower marginal edge region, at an angle to the barrier ridge; and a second locking formation in the lower marginal edge region and comprising locking projections that extend away from the upper marginal edge region and towards the lower edge strip, the locking tabs and projections being shaped to interlock with one another to secure the upper and lower marginal edge regions of adjacent panels together, with the lower edge strip below the barrier ridge.

Other aspects of the present invention provide complementary locking channels and projections, extending generally perpendicularly to the plane of the panel, from the upper and lower marginal end regions of the panel elements.

BRIEF DESCRIPTION OF THE DRAWING FIGURES

For a better understanding of the present invention and to show more clearly how it may be carried into effect, reference will now be made to the accompanying drawings in which.

DESCRIPTION OF THE PREFERRED EMBODIMENTS

Figure 1:
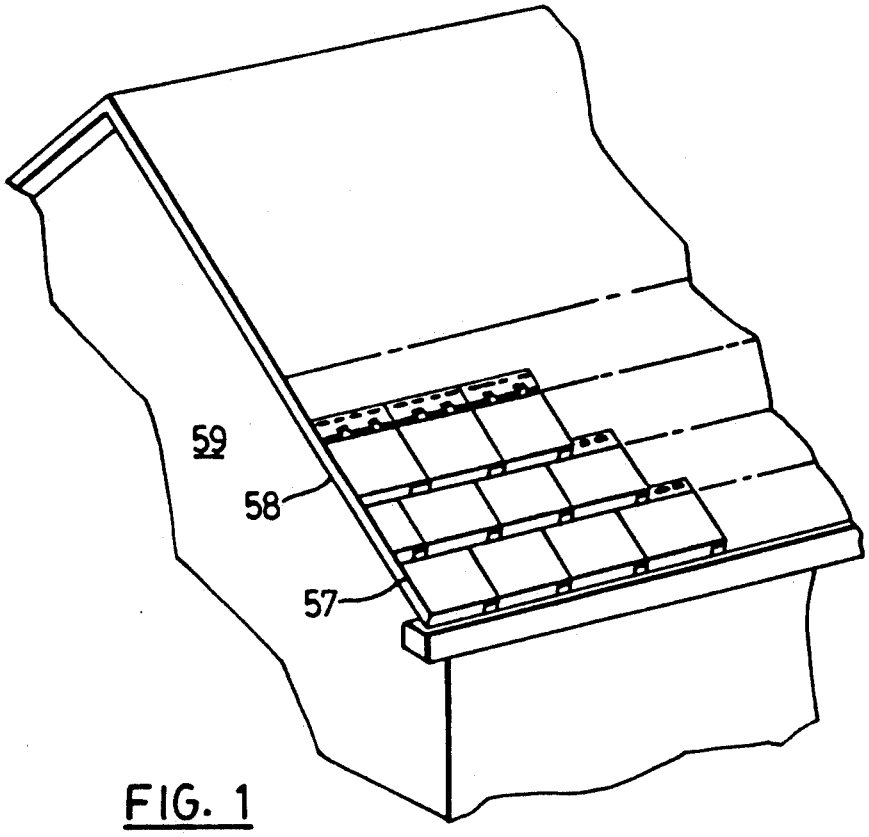
FIG. 1 is a perspective view of a plurality of rows of tiles that form the wall or roof covering of the present invention, showing the individual tiles in assembled relation to each other.

The present invention may be subject to various modifications and alternative constructions, however certain embodiments thereof have been shown in the drawings and will be described below in detail. It should be understood that there is no intention to limit the invention to the specific forms disclosed but to cover all modifications, alternative constructions and equivalents falling with the spirit and scope of the invention.

Referring more particularly to the drawings, there is shown a wall covering 8 comprising a single tile or panel element 12 which embodies the present invention. While panel element 12 is shown used as a roofing panel, it could equally be used as an exterior wall covering on a vertical wall, and accordingly, is herein denoted as a panel element. The panel 12 can be moulded out of any thin rigid plastic material or any other material which can be moulded or formed into a thin and rigid product.

Figures 6, 7, 8:
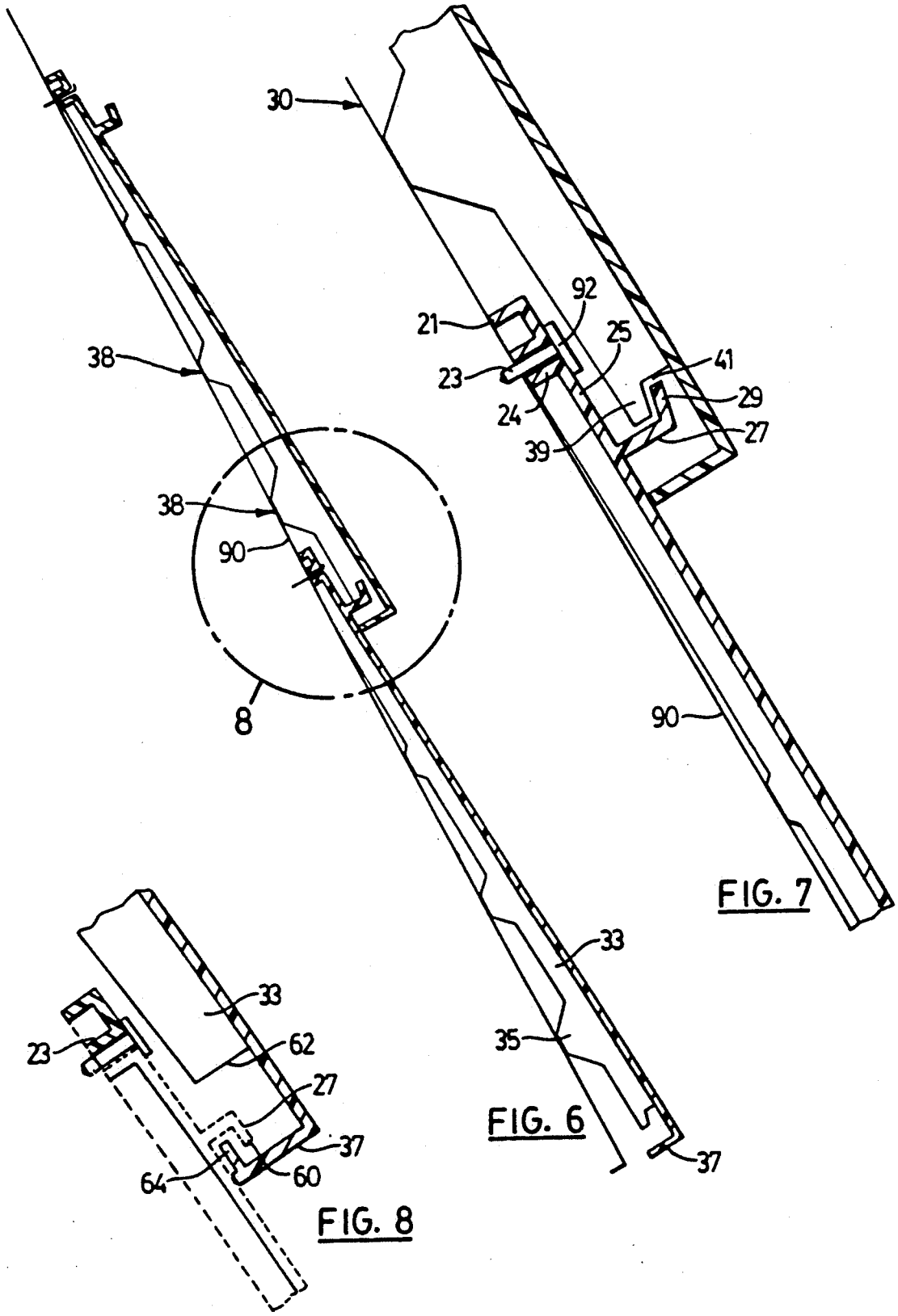
FIG. 6 is vertical section through two tile panels showing the overlapping lower and upper marginal edge regions of the tile panels.
FIG. 7 is an enlarged fragmentary section of the two tile panels in FIG. 6 showing the overlapping lower and upper marginal edge regions.
FIGS. 8, 9 and 10 are fragmentary sections of two tile panels showing alternative embodiments of the overlapping lower and upper marginal edge regions of the tile panels.

For simplicity, the panel elements 12 are described as oriented in use on a roof, i.e. as shown in FIGS. 6 and 7. Terms such as "upwardly", "downwardly", or "lower", in both the specification and claims, should be construed accordingly. More particularly, in both the specification and the claims, the terms "upwardly" and "downwardly" refer to directions substantially perpendicular to a base plane of the panel element, which is parallel to an underlying support surface, and respectively indicate directions above and below the panel.

While the panel is described as rigid, it will be appreciated that the material should be sufficiently flexible to deflect to accommodate unevenness in a roof and any applied loads, in known manner. Further, the material should be capable of withstanding continuous exposure to the weather, and for example, it should not be degraded by prolonged exposure to sunlight.

Each panel 12 has an upper marginal edge region 13 extending across the top of the panel, a lower marginal edge region 15 which defines a lower peripheral edge of the panel, and right and left side marginal edge regions 17 and 19.

To enable nailing of the panels 12 to a support surface 90 of a wall or roof structure, the upper marginal edge region 13 of each panel is formed with a plurality of laterally spaced nailing apertures 23. The nailing apertures 23 are elongated.

Figure 4:
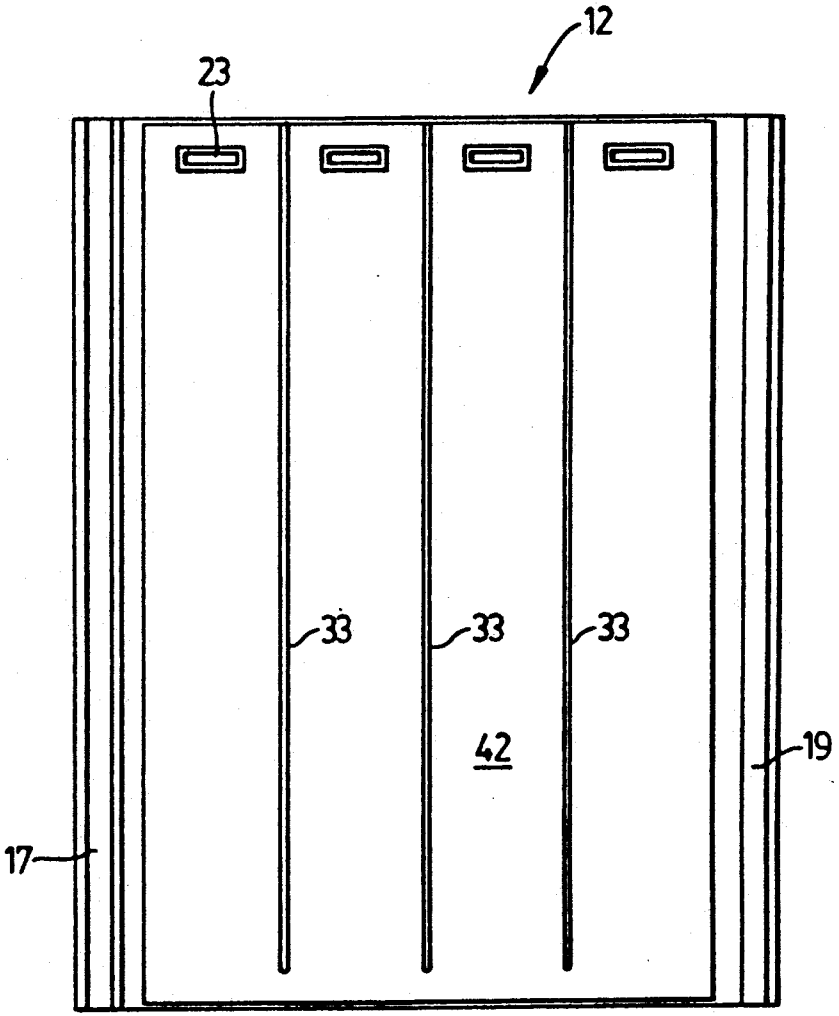
FIG. 4 is a plan view of one tile from the back.
Figure 3:
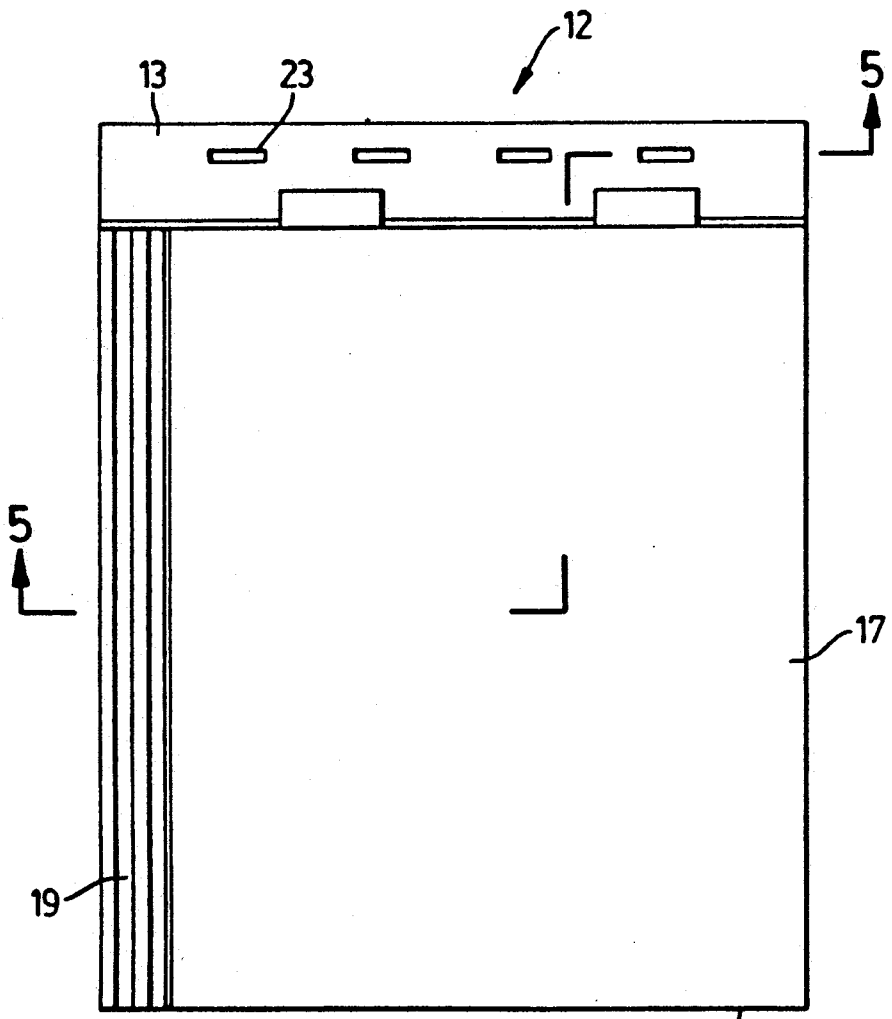
FIG. 3 is a plan view of one tile from the front.

To permit stable mounting of each panel 12 on the support surface 90, a series of stable support ribs 33 are defined along the rear face 42 (FIGS. 6 and 4). Support ribs 33 bear against the face of the underlying support surface 90.

As is known in the art, the panels 12 preferably are mounted on the wall or roof as illustrated in FIG. 1 in overlapping relation to one another, beginning with the right hand panel of the lowermost course to be installed.

The upper marginal edge region 13, is generally planar and includes an upper edge strip 21, and nail apertures 23. The nail apertures 23 are elongate in a transverse direction. As shown in FIG. 7, the nail apertures 23 are defined by a correspondingly shaped wall 24, which together with the edge strip 21, ensures that a planar part 25 of the upper marginal edge region 13 is spaced from an underlying surface. The planar part 25 continues into a main planar body 31.

Figure 2:
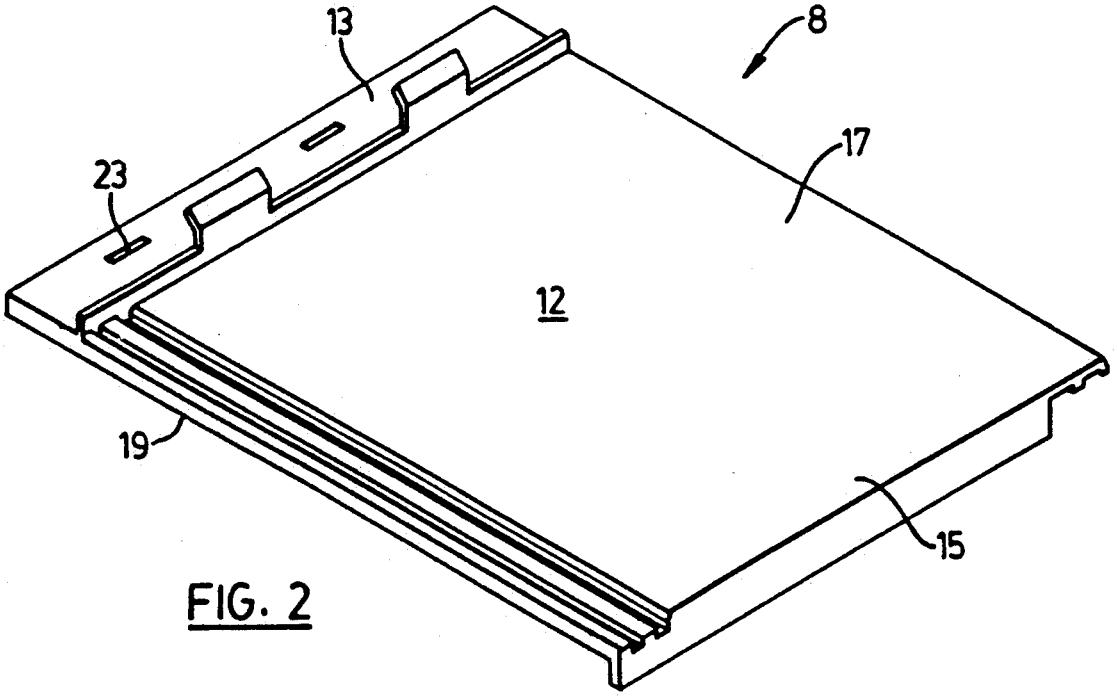
FIG. 2 is a perspective view of one tile showing the upper marginal edge region in detail.

Below the nail apertures 23, and on top of the body 31, there is a continuous horizontally extending barrier ridge 27, which extends upwardly and generally perpendicularly to a base plane of the panel 12. As best shown in FIG. 2, at two locations, there are locking tabs 29, extending upwardly towards the nail apertures 23, and slightly outwardly, relative to a bottom plane of the panel element 12, i.e. the plane of the support surface 90.

It will be appreciated that the outer surface of the planar body 31 gives the principal external appearance to the panel 12. As the panel 12 is moulded, this can be given any desired appearance. It can be moulded to simulate a shake, or given a curved appearance to simulate Spanish-type of tiles, etc. Here, a plain flat appearance is provided.

Underneath the main body 31 there is a series of support ribs 33, running longitudinally from the upper edge strip 21, to the lower marginal edge region 15. Each support rib 33, as shown in FIGS. 6 and 7, has a main part with a depth that tapers and varies in depth from top to bottom, with the bottom part having a depth approximately twice that of the top part. Extending down from this main part are three support projections, indicated at 35.

In the lower marginal edge region 15, the ribs 33 stop short of a lower edge strip 37 (FIGS. 4 and 6). Further, each rib 33 terminates in a locking projection 39. The locking projections 39 have an upper surface 41 that is inclined relative to a base plane of the panel element 12, and at an angle corresponding to that of the locking tabs 29. The locking projections 39 are so spaced from the lower edge strip 37 as to permit the locking tabs 29 to engage those projections 39, as detailed below and as shown in FIG. 7.

Figure 5:
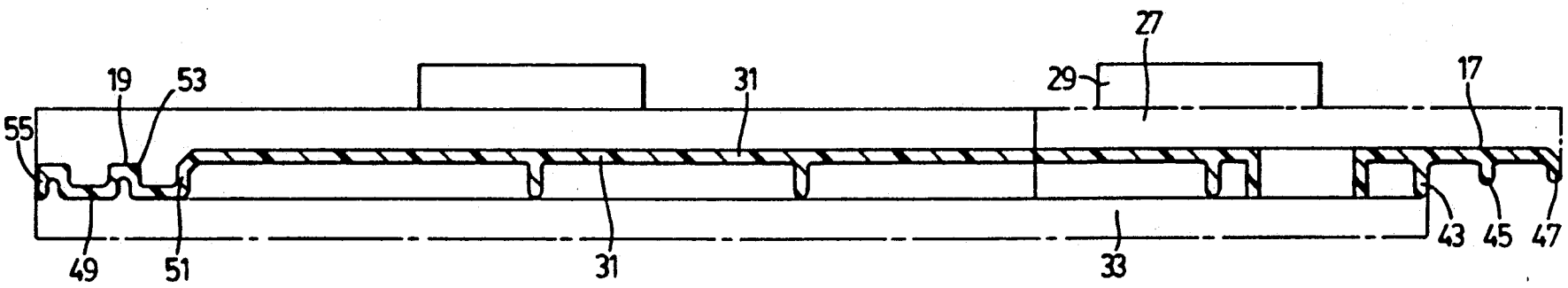
FIG. 5 is a sectional view along line 5—5 of FIG. 3.

To provide lateral water sealing, the edge regions 17, 19 are provided with complementary rib profiles, as best shown in FIG. 5.

The right hand marginal edge region 17 has a planar part that is essentially a continuation of the main planar body 31. Extending downwardly from this is an inner side rib 43, a central sealing rib 45, and an outer rib 47.

Correspondingly, on the left hand side, the marginal edge region 19 has a main part 49, which is spaced downwardly from the main body part 31. Extending upwardly from this part 49 is an inner side rib 51, a central rib 53, and an outer rib 55. As shown, the ribs 53, 55 are formed as inverted U-shaped elements of substantial width.

In use, adjacent panels are mounted with their marginal edge regions 17, 19 engaging one another. The inner side rib 43 of one panel would then abut the outer rib 55 of the other panel, with the outer rib 47 abutting the other inner side rib 51. It will be appreciated that the sealing rib 45 is then received between the ribs 53, 55, with the outer rib 47 located between the ribs 51, 53. This then effectively establishes a tortuous and undulating path for water attempting to seep between the edges of adjacent tiles. Water would, in effect, have to travel over both the ribs 53, 55, before being able to penetrate to the underlying structure. To do this, it would also have to travel around the downwardly extending ribs 45, 47.

It will be noted that the locking tabs 29 are located directly above a pair of ribs 33. This is necessary for alignment of the panels 12, as detailed below, and also to support the tabs 29.

The spacing between the tabs 29, and hence also the ribs 33, is selected to enable adjacent rows to be offset by half a panel 12. The effective panel spacing in a row is the width of the panel 12, as shown, less the width of one edge region 17 or 19, as these overlap. The tabs 29 are thus spaced apart by half this effective spacing. This ensure that adjacent tabs 29 on two adjacent panels 12 in a row will also be spaced by the same amount, ensuring proper engagement with a panel 12 laid in the next row.

In use, in known manner, the tiles would be laid commencing near the bottom of a roof and laid in an overlapping pattern of successive rows. Each higher row would overlap the row below, so as to cover up nails securing that row in position and ensure that water cascades down from one row to the top surface of the row below and so on. Also, in known manner, the tiles are preferred to be laid with adjacent rows offset by half a tile width. For the lowermost row, to secure the lower edges of the tiles, upper marginal edge regions can be cut from some tiles or panels 12 and laid along the roof edge, for engaging and holding the bottom edges of the tiles in position.

Due to the overlapping configuration of the marginal regions 17, 19, the first panel in each row would be laid at the right hand side of the row, and the panels laid progressively across that row to the left. For the first row, the panels are laid with their lower edges at the edge of the roof, and nailed in place. Each successive panel is nailed in place with its right hand marginal region 17 engaging the left hand edge region of the previously laid panel. At the edges of the roof, the panels could be trimmed to size, in known manner.

In FIG. 1, the first row of panels is indicated at 57, and successive rows of panels are indicated at 58, 59.

For the subsequent rows of panels 58, 59, etc., each panel element or tile 12 would be generally similarly laid. However, its lower marginal edge region 15 would first be placed over the barrier ridge 27 and locking tabs 29 of two panel elements 12 of the previous row. As shown, and in known manner, the panel elements in each row would be offset so that the separating lines between the pairs of panels are of f set f rom row to row. Here, the locking tabs 29 are so positioned so that a panel element, laid in row 58, has a pair of its locking projections 39 engaging a pair of locking tabs 29 of adjacent panel elements 12 in the first row 57. After each panel element 12 in row 58 is placed in position with the barrier ridge 27 overlapped by its lower edge strip 37, it is slid downwards to bring the locking tabs 29 and locking projections 39 into engagement with one another, as shown in FIG. 7. It would then be nailed in position in known manner, nails being shown at 92 in FIG. 7.

When the roof is entirely covered except for the ridge, the ridge can be finished with specialized ridge elements, which match the panel elements 12 in design, colour and texture, etc. In known manner, the ridge elements can be generally in the form of a rounded, inverted V-shape, with an angle corresponding to the pitch of the roof. They can be provided with apertures for securing nails at one end and overlapped with one another as for the panel elements 12. Appropriate ridges would be provided to prevent water penetration.

Figure 9:
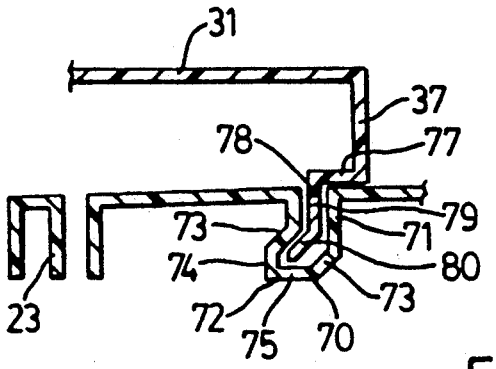
Figure 10:
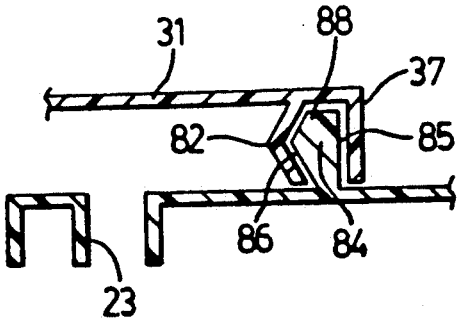

Reference will now be made to FIGS. 8, 9 and 10, which show alternative embodiments of the present invention. In these Figures, like parts are given the same reference numerals as the earlier Figures.

In FIG. 8, the vertical barrier ridge 27 is provided with tabs 60 that project downwardly generally parallel to a base plane of each panel element. Correspondingly, the support ribs 33 each terminate in a plain, edge 62. The lower edge strip 37 is provided with inwardly directed locking projections 64, for engaging the tab 60. Here, when engaging the panels with one another, the mechanism is slightly different. An upper panel would be placed over the nail apertures 23 and barrier ridge 27 of a lower panel. Then, instead of being slid downwards, it would be pulled upwards to bring the tabs and projections 60, 64 into engagement with one another.

Turning to FIG. 9, this shows a further variant. Here, the barrier ridge 27 is omitted. Instead, a locking channel 70 is provided below the nail apertures 23. The channel 70 comprises an upper portion 71 with generally parallel side walls that are substantially perpendicular to the base plane of the panel element, so as to be perpendicular to a surface on which it is mounted. A lower portion 72 has inclined side wall 73, so that an end wall 74 and bottom wall 75 are offset to one side.

Correspondingly, the lower edge strip 37 is provided with an abutment strip 77, generally parallel to the main body 31 of the panel, and a locking projection 78. The locking projection 78 can either be continuous across the width of the panel, or intermittent like the locking tabs 29. Corresponding to channel 70, the locking projection 78 has an upper portion 79 which is, again, generally vertical in FIG. 9, so as to be perpendicular to a support surface, and a lower portion indicated at 80, which is inclined, corresponding to the inclined side walls 73.

In use, the lower edge of one panel would be placed on top of the upper edge of a previously laid panel so that the locking projection 78 commences to enter the channel 70. The projection 78 can then be fully engaged simply by pressing down on the edge of the upper panel, to cause it to snap into place. The various components, principally the components 37, 77 and 78, would have sufficient resiliency to enable this to occur. For this purpose, the ribs 33 could still terminate short of the strip 37. This provides for secure connection of adjacent panels; it does not rely upon an installer ensuring proper engagement of locking projections and tabs.

FIG. 10 shows another snap arrangement, comparable in some ways to FIG. 9. Here, the lower edge strip 37 has no extensions or protrusions. Instead, an inner wall 82 has, in section, straight upper and lower parts, forming an obtuse angle as shown. Correspondingly, the upper marginal region 13 of each panel has, below the nail apertures 23, a locking projection 84, which has a planar lower face 85, and an upper face 86, which has two surfaces at an obtuse angle, corresponding to the profile of the inner wall 82. The projection 84 has a top surface 88 which is narrower than the spacing between the free ends of the edge strip 37 and inner wall 82. The projection 84, and a corresponding channel between strip 37 and inner wall 82, are both wider in the middle than at either end. In use, by resilient deflection of the strip 37 and wall 82, the projection 84 can be snapped into engagement in the channel formed between strip 37 and wall 82.

It will be appreciated that, once in place, each panel element is in effect individually sealed against water from entering. The complementary sealing ribs of marginal edge regions 17 and 19 of adjacent panel elements are essentially perpendicular to vertical barrier ridge 27. The marginal edge regions form a continuous moisture barrier with the vertical barrier ridge.

While preferred embodiments of the invention have been described, it will be appreciated that numerous changes and modifications can be made within the scope of the present invention. For example, while the first embodiment shown in FIGS. 1–7 shows discrete locking tabs 29, these tabs 29 could be made either continuous or of different widths to that shown. This has the advantage of permitting adjacent rows to be offset laterally by different amounts. With discrete tabs 29, the relative offset between adjacent rows has to be maintained within fairly tight tolerances, which may be difficult on old and uneven roof surfaces. The configuration of the tab or tabs should be chosen, bearing in mind ease of installing the tiles, as well as ease of moulding them. The provision of the tabs prevent the tile being moulded in a simple two-part mould, and hence, they should be configured so as not to unduly complicate mould design.

While the drawings show a panel representing a single conventional tile, the panel could be made larger. As the panel is moulded from plastic material, it could have a relatively uniform thickness much less than that of conventional tiles; for example, it could be 2.5 mm thick. This enables large tiles to be moulded which simulate a number of conventional tiles or building elements.

We claim:

1. A panel element, which is generally rectangular, for mounting on a support surface and forming a continuous covering with a plurality of similar panel elements, the panel element comprising:

a main body;

an upper marginal edge region along one, upper edge of the main body, including apertures for fasteners, for fastening the panel element to an underlying support surface, and a barrier ridge extending generally upwardly above the main body, to hinder upward movement of water towards the fastener apertures;

a lower marginal edge region along another, lower edge of the main body, and adapted to overlap the upper marginal edge region of an adjacent panel element, the lower marginal edge region including a lower edge strip at the lowermost end thereof, extending below the main body;

complementary left and right marginal edge regions along opposite other edges of the main body, and adapted to enable adjacent panels to overlap and engage one another, the marginal edge regions being configured to impede flow of water between engaged edge regions of adjacent panels;

a first locking formation provided below the upper marginal edge region, so as to be below any fasteners inserted through the upper marginal edge region, the first locking formation comprising a plurality of locking tabs extending away from the lower marginal edge region, at an angle to the barrier ridge; and a second locking formation in the lower marginal edge region and comprising locking projections that extend away from the upper marginal edge region and towards the lower edge strip, the locking tabs and projections being shaped to interlock with one another to secure the upper and lower marginal edge regions of adjacent panels together, with the lower edge strip below the barrier ridge.

2. A panel element, for mounting on a support surface and forming a continuous covering with a plurality of similar panel elements, the panel element comprising:

a main body;

an upper marginal edge region along one, upper edge of the main body and adapted for fastening to an underlying support surface;

a lower marginal edge region along another edge of the main body, and adapted to overlap the upper marginal edge region of an adjacent panel element;

complementary left and right marginal edge regions along opposite other edges of the main body, and adapted to enable adjacent panels to overlap and engage one another, the marginal edge regions being configured to impede flow of water therebetween;

a first locking formation provided below the upper marginal edge region, so as to be below any fasteners inserted through the upper marginal edge region, the first locking formation comprising a locking channel; and a second locking formation in the lower marginal edge region and including a lower edge strip, extending generally perpendicularly to the main body of the panel element, an abutment strip extending from the lower edge strip, generally parallel to the main body and towards the upper marginal edge region, and a locking projection, extending from the abutment strip and generally perpendicularly relative to the main body, the locking projection having a profile corresponding to that of the locking channel for engagement therewith, the abutment strip in use, abutting another panel element adjacent the locking channel thereof.

3. A panel element, for mounting on a support surface and forming a continuous covering with a plurality of similar panel elements, the panel element comprising:

a main body;

an upper marginal edge region along one, upper edge of the main body including apertures for fasteners, for fastening the panel element to an underlying support surface;

a lower marginal edge region along another edge of the main body, and adapted to overlap the upper marginal edge region of an adjacent panel element;

complementary left and right marginal edge regions along opposite other edges of the main body, and adapted to enable adjacent panels to overlap and engage one another, the marginal edge regions being configured to impede flow of water therebetween;

a first locking formation provided below the upper marginal edge region, so as to be below any fasteners inserted through the upper marginal edge region, the first locking formation comprising an upstanding projection, having a middle portion that is wider than the top and bottom thereof, the locking formation comprising an upstanding projection, having a middle portion that is wider than the top and bottom thereof, the locking projection extending generally perpendicularly to the main body below the upper marginal edge region; and a second locking formation in the lower marginal edge region and comprising a lower edge strip and another wall, which together define a locking channel having a width at the middle thereof which is greater than the width of the top or bottom thereof, for resilient engagement with the locking projection.

4. A panel element as claimed in claim 1, 2, wherein one of the complementary left and right marginal edge regions includes a plurality of generally parallel and upwardly extending ribs and the other of said marginal edge regions includes a plurality of generally parallel and downwardly extending ribs adapted to extend between said upwardly extending ribs.

5. A panel element as claimed in claim 2, 3, which includes a plurality of reinforcing ribs which extend generally longitudinally.

6. A panel element as claimed in claim 5, wherein the ribs are generally parallel to one another, and uniformly spaced, and extend through the upper marginal edge region and terminate before the lower edge strip, and wherein each rib includes a plurality of support projections lying in a common base plane, for supporting the panel element on a planar surface.

7. A panel element as claimed in claim 2, wherein the channel comprises an upper portion generally perpendicular to the main body of the panel and a lower portion inclined at an obtuse angle thereto, and the locking projection comprising upper and lower parts at an obtuse angle to one another, with the upper part being generally perpendicular to the abutment strip, for engagement in the locking channel.

8. A panel element as claimed in claim 3, wherein the locking projection has one planar face and another face comprising two generally planar surfaces at an obtuse angle relative to one another, the lower edge strip has a planar face corresponding to the planar face of the locking projection, and the inner side wall has two faces at an obtuse angle corresponding to the two surfaces of the locking projection.

9. A panel element as claimed in claim 3, wherein the locking channel and locking projection comprise a plurality of discrete locking channels and locking projections.

10. A panel element as claimed in claim 1, which includes a plurality of reinforcing ribs beneath the main body thereof, which ribs extend generally longitudinally, and at least some of which include the locking projections in the lower marginal edge region.

11. A panel element as claimed in claim 10, which includes two locking tabs, which are spaced apart by a distance equal to half the width of the panel element, less the overlapping width of the left and right marginal edge regions, and which are generally equally spaced from those left and right marginal edge regions, and wherein there are two ribs extending longitudinally below those locking tabs, each of which ribs terminates at a lower end in a locking projection for engaging a locking tab, whereby adjacent rows of panel elements may be offset by the width of half a panel element.

12. A panel element as claimed in claims 1, 10 or 11, wherein at least one of the locking tabs and the locking projections are formed as a single element continuous across the width of the panel element.

13. A panel element as claimed in claim 10 or 11 wherein the ribs are generally parallel to one another, and uniformly spaced, and extend through the upper marginal edge region and terminate before the lower edge strip, and wherein each rib includes a plurality of support projections lying in a common base plane, for supporting the panel element on a planar surface.

* * * * *